US006492907B1

(12) United States Patent
McCracken

(10) Patent No.: US 6,492,907 B1
(45) Date of Patent: Dec. 10, 2002

(54) DETECTOR SYSTEM

(76) Inventor: Robert E. McCracken, 23 Butternut Ct., Aiken, SC (US) 29801

( * ) Notice: Subject to any disclaimer, the term of this patent is extended or adjusted under 35 U.S.C. 154(b) by 0 days.

(21) Appl. No.: 09/654,461

(22) Filed: Sep. 1, 2000

(51) Int. Cl.[7] ..... G08B 17/00
(52) U.S. Cl. ..... 340/628; 340/693.5; 340/539
(58) Field of Search ..... 340/628, 693.5, 340/539, 693.6, 693.11

(56) References Cited

U.S. PATENT DOCUMENTS

| | | | | |
|---|---|---|---|---|
| 4,093,943 | A | | 6/1978 | Knight |
| 4,305,069 | A | | 12/1981 | Machen et al. |
| 4,419,658 | A | | 12/1983 | Jarosz et al. |
| 4,600,314 | A | | 7/1986 | Theiriault |
| 4,611,200 | A | | 9/1986 | Stilwell |
| 4,694,285 | A | | 9/1987 | Scripps |
| 4,717,910 | A | | 1/1988 | Scripps et al. |
| 4,796,015 | A | | 1/1989 | Admire, Jr. |
| 4,893,324 | A | | 1/1990 | Scown |
| 4,904,988 | A | | 2/1990 | Nesbit et al. |
| 4,954,816 | A | | 9/1990 | Mattison |
| 5,211,570 | A | | 5/1993 | Bitney |
| 5,243,329 | A | | 9/1993 | Happer, Jr. |
| 5,432,500 | A | * | 7/1995 | Scripps ..... 340/628 |
| 5,481,442 | A | | 1/1996 | Dickie et al. |
| 5,574,436 | A | | 11/1996 | Siselman et al. |
| 5,640,058 | A | | 6/1997 | Calvo |
| 6,172,612 | B1 | * | 1/2001 | Odachowski ..... 340/628 |

* cited by examiner

*Primary Examiner*—Julie Lieu
(74) *Attorney, Agent, or Firm*—Fitch, Even, Tabin & Flannery

(57) ABSTRACT

A smoke detector apparatus that provides a generally continuous supply of electrical power to a smoke detector unit. The apparatus provides flexibility in locating the detector unit while still generally maintaining uninterrupted access to electrical power. In various forms, the apparatus allows for mounting of a smoke detector unit remote from an electrical wall outlet. Generally uninterrupted power from the electrical system of a home or building to the smoke detector unit may be provided by way of an integral mounting plate, blocking member, and/or outlet covers.

19 Claims, 8 Drawing Sheets

DETECTOR SYSTEM

FIELD OF THE INVENTION

The invention relates to smoke detector units and, more particularly, to apparatus securely connecting detector units to electrical systems in a home or building.

BACKGROUND OF THE INVENTION

The risk and extent of property loss, personal injury, and death from fire and smoke can be minimized when smoke detectors are properly employed to provide warning during the initial stages of a fire. Laws in many jurisdictions require that smoke and/or heat detectors be provided in public and commercial buildings and private homes. This has led to the development of a wide variety of commercially available smoke detectors, some of which are battery operated and some of which are connected to the electrical system of a home or building by a permanent wiring connection or by reception of the male plugs on their power cords in female wall outlets.

A permanent wiring connection is preferable, but costly and difficult to install after construction of a home or building. A drawback of using a permanent wiring connection is the necessity that the smoke detector be connected at the location of the permanent wiring connection. This may result in the smoke detector being mounted in an inaccessible or non-ideal location. Smoke detectors that plug into a female wall outlet are susceptible to inadvertent removal from the female wall outlet. There may be excess length of power cord between the smoke detector and the female wall outlet. The excess length may be pulled, such as by a vacuum cleaner or a foot of person, thus pulling the male plugs from the female wall outlet and disconnecting the power supply to the smoke detector. The male plugs may also be removed from the female wall outlet for access to the female wall outlet by a user. This presents the risk that the user will inadvertently forget to reinsert the male plugs into the smoke detector, thus rendering the smoke detector inoperable.

Fire safety experts often recommend that smoke alarm detectors be placed on or near the ceiling of a room and preferably near the center. A problem with ceiling mounted detectors powered by batteries, rechargeable or otherwise, is that they are difficult to reach and deactivate in the event that the alarm is inadvertently triggered by a condition which is not dangerous. For example, ordinary cigarette and cooking smoke have the capability to trigger a smoke alarm, as does steam from a kitchen or a shower, and a triggered alarm will normally remain operative until the alarm triggering condition dissipates or someone deactivates the device. Furthermore, fire safety experts recommend that ceiling mounted detectors powered by rechargeable batteries be tested at least every six months to ensure that the batteries are still operational, and nonrechargeable batteries must be replaced fairly often.

Testing, recharging, and replacing batteries in a smoke alarm is often accomplished by pushing a button or other activating switch on the body of the detector. It can be difficult or impossible, however, particularly for elderly or infirmed persons, to reach ceiling mounted detectors or wall-mounted detectors at higher altitudes for these purposes.

Residential home owners who live in locations where construction codes do not require hard-wired smoke detectors or live in structures built prior to existing code requirements also may need smoke alarm detectors that are not powered exclusively by batteries. For example, a residential home owner may prefer the safety and convenience of having a hard-wired type smoke detector instead of having the inconsistent reliability of battery powered smoke detectors.

Prior smoke detectors have attempted to address the various problems facing battery powered smoke detectors. One such device is disclosed in U.S. Pat. No. 5,432,500, which discloses a smoke detector that is threaded into a light fixture, using the wiring thereto as its power source. While the disclosed detector does not depend upon batteries for operation, the detector may be inadvertently turned off by the light switch which controls the ceiling light fixture.

Despite the existing laws and building codes pertaining to smoke detectors, it is estimated that at least one-third of all battery powered smoke detectors are inoperable at a given point in time due to depleted or absent batteries. However, as many existing dwellings were not built to allow for hard-wired AC detectors and have no immediate means by which to utilize the more reliable AC models, they have been forced to rely on battery powered units.

SUMMARY OF THE INVENTION

In accordance with the present invention, an apparatus that provides uninterrupted power to a smoke detector unit from a home's or building's electrical system is provided. Unlike smoke detectors that are hard-wired to electrical systems, the present apparatus provides a home owner or building occupant significant flexibility in term of where to locate the detector unit while still securing uninterrupted access to the power provided by the electrical system of the home or building.

In a preferred form, the apparatus includes a power supply line of adjustable length with an integral outlet cover plate and male plug blades at one end. In this manner, one can remove the existing cover plate, insert the male plug blades into the wall outlet, and fasten the integral cover plate to the wall or ceiling to prevent accidental disconnections of the power supply line from the electrical system of the home or building. Another form of the apparatus allows a user to use the female socket of a standard lamp to provide uninterrupted power from the electrical system to the smoke detector unit via a blocking member of the smoke detector unit that covers the lamp switch in the on position, and an outlet cover that maintains the lamp cord plugged into the wall outlet. In yet another form of the apparatus, one can use the apparatus with the wiring of a light fixture. Either a protective sheath can be provided on the smoke detector unit for covering a switch, e.g., a pull chain, at the light fixture, or a wall switch faceplate can be used for covering a standard wall switch. In this form where the blocking member is the wall switch faceplate, the smoke detector unit can include a socket connected to internal power circuitry, and the wall switch faceplate can include a radio transmitter with a switch for sending a radio signal to receiving circuitry that provides power through the internal power circuitry to a female lightbulb socket formed in the smoke detector unit.

As is apparent, the present apparatus allows considerable latitude in determining the location of the smoke detector unit rather than having the location preset as dictated by a permanent wiring connection, placed by a home builder or the like, while still securing access to uninterrupted power from the electrical system of a home or building unlike prior plug in types using only power cords. In various forms, the apparatus allows the user to change the length of the power supply line to allow the unit to be mounted at various locations without excess length of the power supply line exposed for accidental contact by a vacuum cleaner or a person's foot. The locations can be remote from the wall outlet, or next to any lamp in the home or building, or using the wiring for any light fixture in the home or building. In each of the above-described forms, substantially uninterrupted power from the electrical system of the home or business to the smoke detector unit is maintained by way of an integral mounting plate or a blocking member and/or outlet covers.

In a preferred form of the invention the smoke detector apparatus includes a small, portable smoke detector unit that is capable of installation in the home or building. The smoke detector unit has a smoke detecting mechanism therein. The smoke detecting mechanism may comprise ionization type detection and/or photoelectric detection. An audible alarm is provided for sounding when the smoke detection mechanism detects dangerous amounts of smoke in the home or building. The smoke detector unit contains electrical circuitry for receiving power to operate the smoke detecting mechanism and the audible alarm.

A power supply line is provided to connect the smoke detecting unit to the electrical system of the home or building. A first end of the power supply line has a mounting plate intergrally formed as by molding thereon. The mounting plate is in the form of an outlet cover plate including openings for allowing male plug blades to be inserted into the standard female electric socket of the wall outlet of the electrical system of the home or building. The first end may also have a standard female electrical socket formed thereon. A second end of the power supply line is electrically connected to the smoke detector unit to provide power to the electrical circuitry of the smoke detector unit. The power supply line may be cut to tailor its length so that it extends between the mounting plate and the smoke detector unit wherever the smoke detector unit is mounted in the home or building. The mounting plate replaces the existing cover plate of the wall outlet and is fastened to the wall so that male plug blades carried thereby and electrically connected to the power supply line are secured in the female electric socket.

The smoke detector unit may have a "quick connect" feature for electrically connecting the power supply line with the electrical circuitry of the smoke detector unit. The "quick connect" feature may include push down tabs that make electrical contact with the power supply line.

A conduit is also provided for attaching a portion of the power supply line between the ends of the power supply line to a wall or other surface of the home or building. The conduit can be cut to the necessary length to cover the portion of the power supply line. The conduit may be attached to the wall using an adhesive backing on the conduit. The conduit may be formed of extruded plastic and may be generally U-shaped in cross section for receiving the portion of the power supply line therein.

The mounting plate is adapted for fitting over a standard wall outlet electrically connected to the electrical system in a home or building. The mounting plate may be formed in a decorative shape, such as a fire truck or a cartoon character for use in a child's bedroom. The wall outlet may have one or more electric sockets. An existing outlet cover in a home or building may be removed and replaced with the mounting plate. The interior of the mounting plate has male plug blades electrically connected to the first end of the power supply line for insertion into the electric socket of the wall outlet to supply power from the electrical system to the electrical circuitry of the smoke detector unit. Fastening the mounting plate to the wall outlet provides a secure connection between the electrical system of the home or building and the smoke detector unit. When the mounting plate is fastened to the wall outlet the power supply line resists accidental removal from the electric socket. For example, accidentally pulling the power supply line, such as by engaging it with a vacuum cleaner during ordinary cleaning or inadvertently tripping over it with a person's foot, will not interrupt the power supply to the smoke detector unit.

The mounting plate may have an opening for access to an electric socket of the wall outlet not occupied by the plug blades. This allows users to use available electric sockets on the wall outlet for other uses while still maintaining the power supply line in connection with the electrical power system of the home or business. The mounting plate can also include a retractable cover to block access an open electric sockets on the wall outlet. This is particularly useful in homes or buildings where small children may be present to prevent electrocution. The retractable cover may have slots for insertion of the male end of an electric cord. The retractable cover may have an integral spring system to force the slots out of alignment with corresponding slots of the electric socket. A user could insert the male end of an electric cord into the slots of the retractable cover and rotate the retractable cover back into alignment with the corresponding slots of the electric socket.

In one form, the smoke detector unit has a non-standard female power outlet formed thereon. The non-standard female power outlet provides electrical power between the electrical circuitry of the smoke detector unit and an accessory. The accessory is designed with a non-standard male plug for insertion into the non-standard female power outlet of the smoke detector unit.

The accessory may have a light for indicating that power is being supplied to the accessory and thus the smoke detector unit.

The accessory may comprise a battery for providing back-up power supply to the electrical circuitry of the smoke detector unit. In the event that the electrical system of the home or building does not supply power to the wall outlet the battery will supply power to electrical circuitry of the smoke detector unit. The accessory may have a battery charger for maintaining the battery at full strength with power from the electrical system of the home or building. The accessory may also have a clock for displaying the time. The clock also provides a visible indication that the smoke detector unit is receiving power from either the battery or the electrical system of the home or building. A light may also be provided on the accessory for indicating when the battery is supplying power to the smoke detector unit and the electrical system of the home or building is not operational.

Other accessories may also be provided for attachment to the smoke detector unit. For example, the accessory may comprise a carbon monoxide detector for alerting when dangerous levels of carbon monoxide gas are present in the home or building. The accessory may alternatively comprise a nightlight for providing illumination. Multiple accessories may be attached to each other using non-standard female power outlets similar to that of the smoke detector unit formed on each accessory. The accessory comprising the nightlight does not have such a power outlet so that it may be used on the end of another accessory or the smoke detector unit without the danger that a small child may be electrocuted by contact with the power outlet.

In another form of the invention, an apparatus is provided including a small, portable smoke detector unit with electrical circuitry therein electrically connected to an intermediate conductive member for supplying power from the electrical system. The intermediate conductive member may include a standard lightbulb socket, such as on a lamp or a ceiling fixture. The intermediate conductive member may also include electrical power leads. The smoke detector unit may have a "quick connect" feature formed for receiving the power leads. The "quick connect" feature may comprise push down tabs that make electrical contact with the power leads.

Power from the electrical system of the home or building to the intermediate conductive member may be controlled by a switch operable by a user between on and off states thereof. In one form the smoke detector unit has male socket threads formed thereon for insertion into the standard lightbulb socket to provide an electrical connection between the standard lightbulb socket and the male socket threads when the switch is in the on state. The smoke detector has a blocking member integral therewith for preventing access to the switch and preventing the accidental operation of the switch by a user from the on to the off state.

A standard female lightbulb socket may be formed in the smoke detector unit for receiving the lightbulb. The socket is electrically connected to the internal power circuitry of the smoke detector unit. The electrical circuitry constantly supplies power to the smoke detecting mechanism and the audible alarm mechanism of the smoke detector unit. The internal power circuitry electrically connects the electrical circuitry and the female lightbulb socket. The internal power circuitry may be switched on and off so that power may be supplied to the female lightbulb socket such that the lightbulb in the female lightbulb socket may be turned on or off without turning off the power from the electrical system of the home to the electrical circuitry of the smoke detector unit. The smoke detector unit may have a hoop integral therewith, the hoop being adapted for attachment of a lampshade to cover the lightbulb inserted in the female lightbulb socket formed in the smoke detector unit.

For a switch mounted to a lightbulb socket on a standard ceiling fixture or on a lamp, the blocking member of the smoke detector may comprise a protective sheath that surrounds the switch to cover the switch in the on state and to prevent access thereto. For a switch mounting to a wall, such as a standard ceiling light switch, the blocking member may comprise a switch plate cover. The switch plate cover may have a recess therein to cover the switch in the on state and to prevent access thereto.

A fixture switch operatively associated with a radio signal transmitter may be provided. For example, the switch plate cover may have the fixture switch formed thereon. The fixture switch may comprise a push button or a replica of a standard toggle found on most wall switches. The transmitter may signal a receiver in the smoke detector unit upon operation of the fixture switch to operate the internal power circuitry of the smoke detector unit to provide power from the electrical circuitry of the smoke detector unit to the socket of the smoke detector unit. Such a fixture switch allows for the activation of a lightbulb in the smoke detector unit without adding any additional electrical wiring to the electrical system of a home of building while maintaining uniterrupted power from the electrical system to the smoke detector unit.

DETAILED DESCRIPTION OF PREFERRED FORMS

Figure 1:
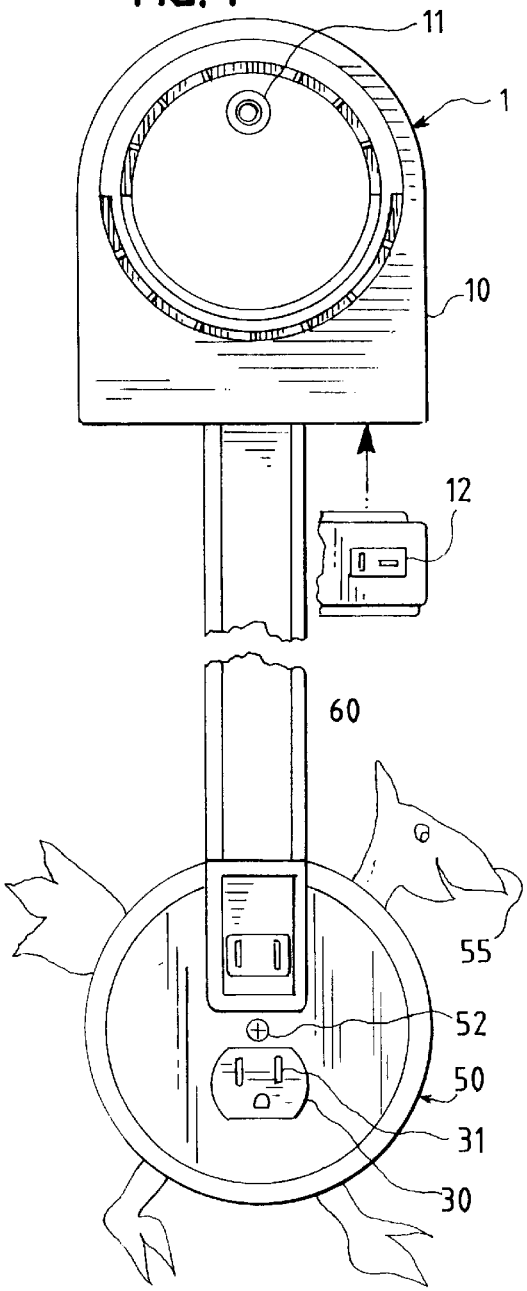
FIG. 1 is a front elevation of a smoke detector for being electrically connected to a wall outlet in accordance with the invention.

In FIGS. 1 through 6, an apparatus 1 is shown that allows a smoke detector unit or housing 10 to be disposed at various locations in a house or building while maintaining secure access to uninterrupted power from the electrical system 210. In various forms the smoke detector unit 10 may be mounted in ideal locations in a home or building, including to a lamp 200, a ceiling fixture 161, or a wall 5.

Figure 11:
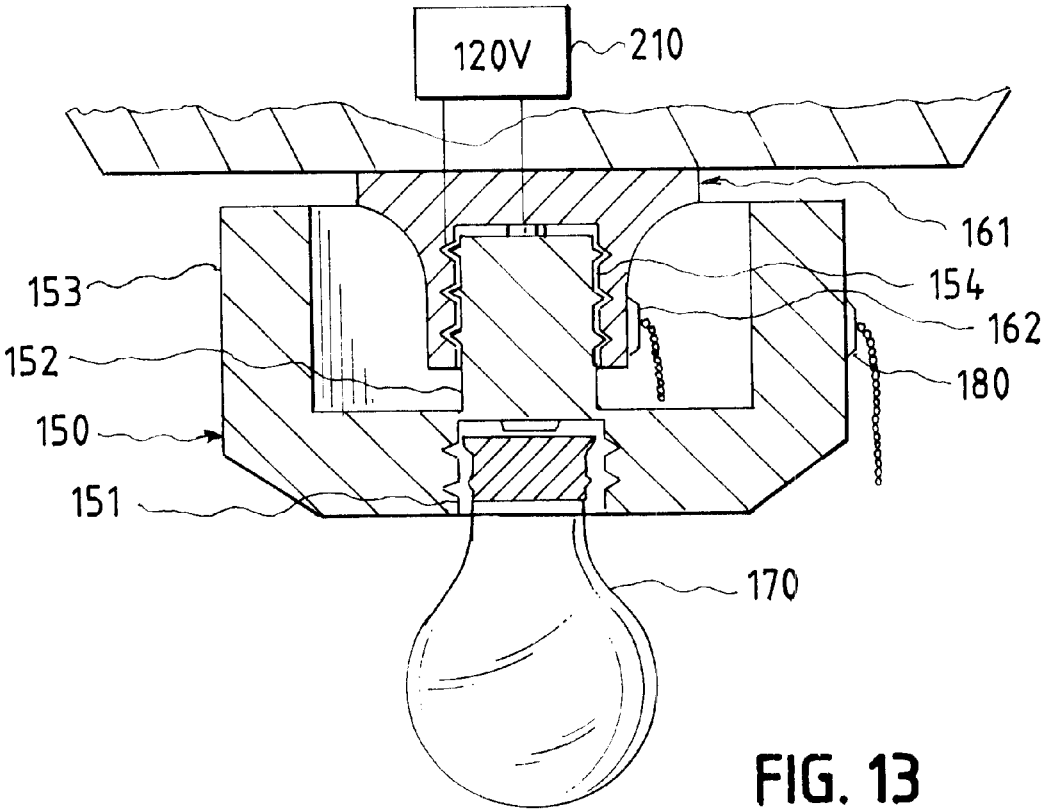
FIG. 11 is a section view of a smoke detector unit integrated with a standard light socket at one end and the male contact adapting thread at the other.
Figure 12:
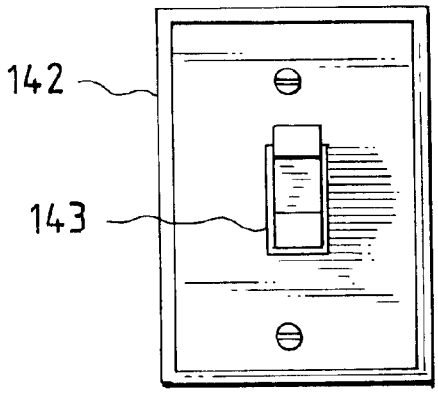
FIG. 12 is a front elevation view of a switch unit for covering a standard wall switch.
Figure 13:
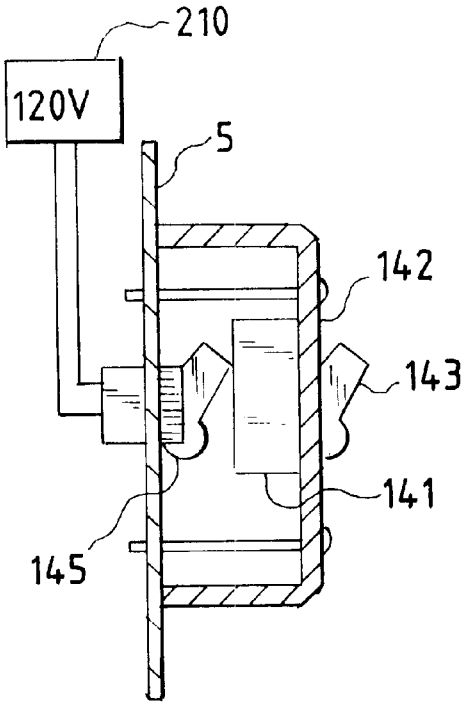
FIG. 13 is a section view of the switch of FIG. 12.
Figure 19:
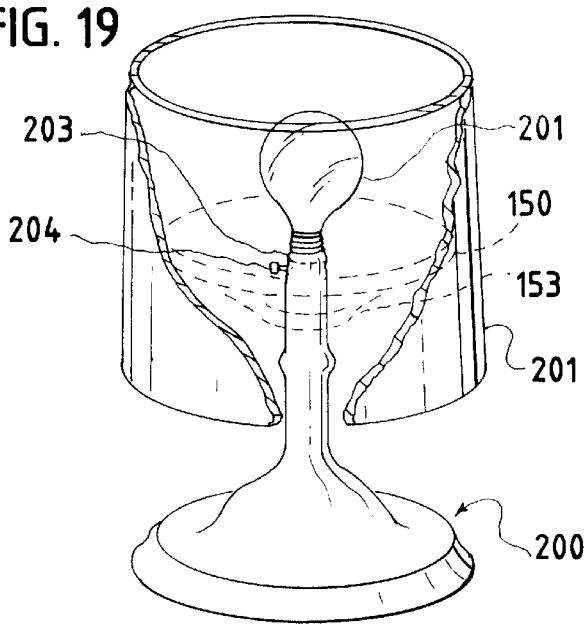
FIG. 19 is a perspective view of the smoke detector unit of FIG. 11 installed on a lamp with a lamp shade partially depicted.

In a preferred form, the apparatus 1 is attached to a female electric socket 31 on a wall outlet 30 by way of a power supply line 40 with an integral mounting plate 50 and plug blades 51. In another form, the smoke detector unit 150 is connected to the electrical system 210 using the female socket 203 of the lamp 200, as depicted in FIG. 19. A protective sheath 153 of the smoke detector unit 150 substantially prevents access to a switch 204 on the lamp 200. In yet another form the smoke detector unit 150 is adaptable to be connected to the wiring of a ceiling fixture 161, as depicted in FIG. 11. A protective sheath 153 can be provided on the smoke detector unit 10 for confining a pull chain switch 162 of the ceiling fixture 161. Alternatively, a wall switch faceplate 142 can be provided for substantially confining a standard wall switch 145, as illustrated in FIGS. 12 and 13.

In a form of the invention the smoke detector unit 10 is electrically connected to an electric system 210 with a power supply line 40 having an integral mounting plate 50. The power supply line 40 may be of adjustable length with the integral mounting plate 50 at an end of the power supply line 40. The end of the power supply line 40 opposite the mounting plate 50 may be cut by a user to alter the length of the power supply line 40. In this manner excess length of the power supply line 40 between the mounting plate 50 and the smoke detector unit 10 may be removed. The end of the power supply line 40 opposite the mounting plate 50 is adapted for electrical connection with the smoke detector unit 10. The power supply line 40 may be a common electrical cord, comprising two conducting wires 41 surrounded by plastic insulation 42, as depicted in FIG. 1A. The plastic insulation 42 on the end of the power supply line 40 opposite the mounting plate 50 may be removed to expose the conducting wires 41 for electrical connection to the smoke detector unit 10.

The mounting plate 50 has male plug blades 51 electrically connected to the end of the power supply line 40 for insertion into the female electric socket 31 of the wall outlet 30. The mounting plate 50 is designed to fit over a standard wall outlet 30 in a home or building. The design of the mounting plate 50 is similar to a standard mounting plate 50 used for covering a wall outlet 30 in a home or building. The wall outlet 30 may have one or more female electrical sockets 31. The interior of the mounting plate 50 has male plug blades 51 electrically connected to the power supply line 40 for insertion into a female electrical socket 31. The mounting plate 50 has an opening for allowing access to a second female electrical socket 31 of the wall outlet 30. The mounting plate 50 has an opening for insertion of a screw 52 to fasten the mounting plate 50 to the wall outlet 30 and thus the wall 5.

Figure 18:
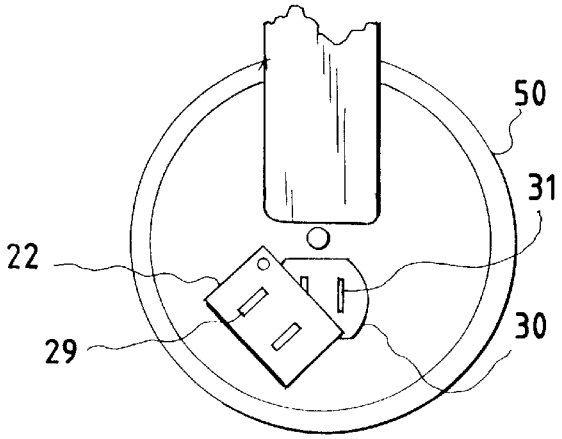
FIG. 18 is a the mounting plate of FIG. 1 with retractable cover partially retracted.

The mounting plate 50 may optionally include a child protection feature wherein a molded-in leaf spring system forces a retractable cover 22 to rotate enough in one direction to block access to the female electrical socket 31 thereunder, as illustrated in FIG. 18. The retractable cover 22 has plug slots 29 corresponding to the female electrical socket 31. The user can rotate the plug slots 29 back into correspondence with the female electrical socket 31 for access thereto. The mounting late 50 may also have a decorative shape or image 55 formed thereon to enhance the visual appeal of the mounting plate 50, such as a cartoon character.

A conduit 61 of predetermined length is provided for covering and protecting a portion of the power supply line 40 extending from the mounting plate 50 on the wall outlet 30 to the smoke detector unit 10. The conduit 60 may be of a decorative color to blend in with the color of the wall 5. The conduit 60 may be formed of extruded plastic and have a generally U-shaped cross section for insertion of the power supply line 40 therein. An adhesive backing 61 may be applied to the conduit 60 to adhere the conduit 60 with the power supply line 40 therein to the wall 5 in the home or building. The conduit 60 may be cut to the length of the power supply line 40.

Figure 1A:
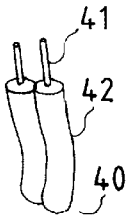
FIG. 1A is an elevation view of the power supply line of FIG. 1.
Figure 20:
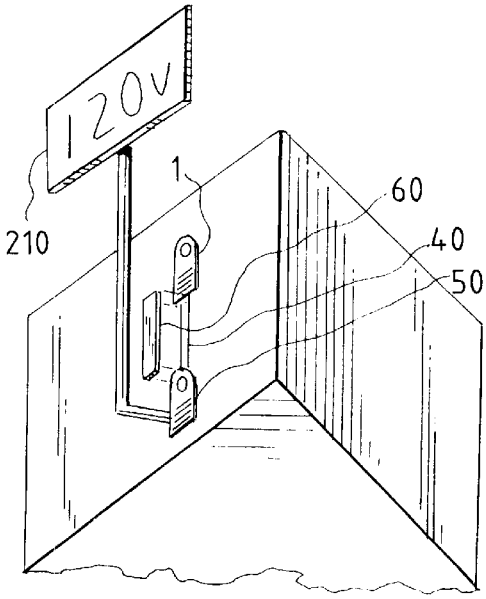
FIG. 20 is a perspective view of a room with the smoke detector unit of FIG. 1 installed therein.

FIG. 20 illustrates a form of the invention where the apparatus 1 of FIG. 1 is attached to the wall 5 of home or building. The mounting plate 50 is attached the wall outlet 30. The power supply line 40 extends from the mounting plate 50 to the smoke detector unit 10. The end of the power supply line 40 may be cut to remove excess length between the smoke detector unit 10 and the wall outlet 30. The conduit 60, shown removed from the power supply line 40, may be cut to the similar length of the power supply line 40 for covering and attaching the power supply line 40 to the wall 5 of the home or building. A light 11 on the smoke detector unit 10 indicates when power is not supplied by the electrical system 210.

In a form of the invention the smoke detector unit 10 also incorporates, as illustrated in FIG. 1, a nonstandard female power outlet 12, located on the bottom edge of the smoke detector unit 10, which allows for the connection of assorted accessories 99. A number of accessories 99 are provided which are mountable to the bottom of the smoke detector unit 10 via the nonstandard female power outlet 12. Each accessory is designed with corresponding nonstandard male plug tabs 90 protruding from its top surface and, with the exception of a nightlight accessory 80, the same type of nonstandard female power outlet 12 on its bottom surface. This allows for individual accessories 99 to be plugged into the smoke detector unit 10 directly or into others of the accessories 99, providing the user with a number of optional accessory 99 combinations and making the apparatus 1 exceedingly versatile.

Figure 3:
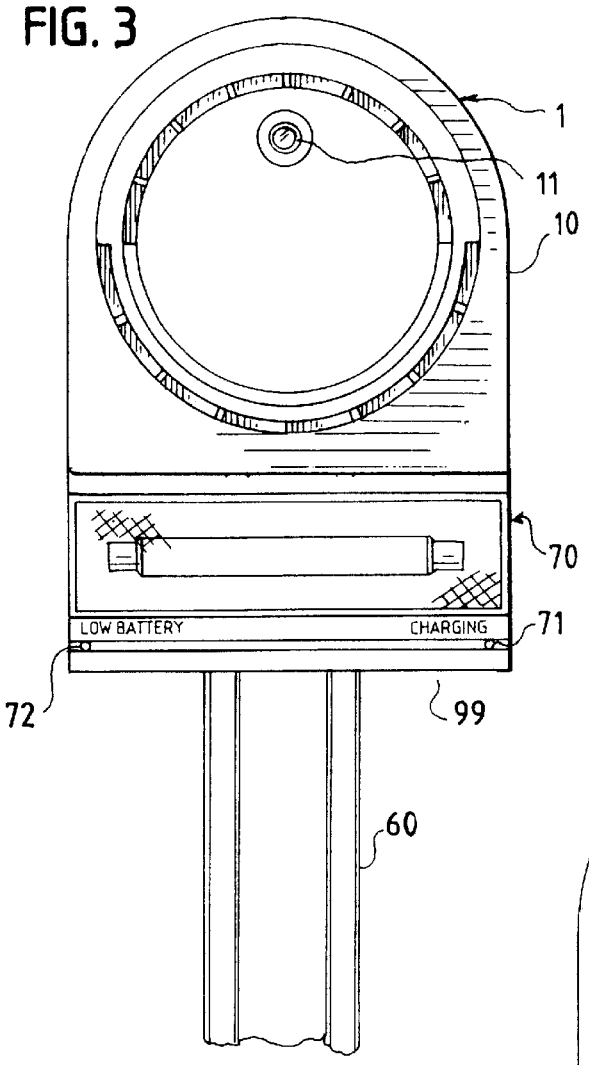
FIG. 3 is a front elevation view of the smoke detector apparatus of FIG. 1 with an attached self-charging power-out light accessory.

Illustrated in FIG. 3 is a power-out light accessory 70. The power-out light accessory 70 contains rechargeable batteries and a charger. On the face of the power-out light accessory 70 is a charging indicator 71 that is lit when the rechargeable batteries are in the process of charging. Also on the face of the power-out light 70 accessory is a low battery indicator 72. The low battery indicator 72 lights up whenever the rechargeable batteries are depleted. When the power from the electrical system 210 to the smoke detector unit 10 is interrupted, the power-out light 72 is lit to indicate that the power is out. Additionally, the rechargeable batteries provide a temporary source of power for the smoke detector unit 10 until the power interruption can be identified and rectified.

Figure 4:
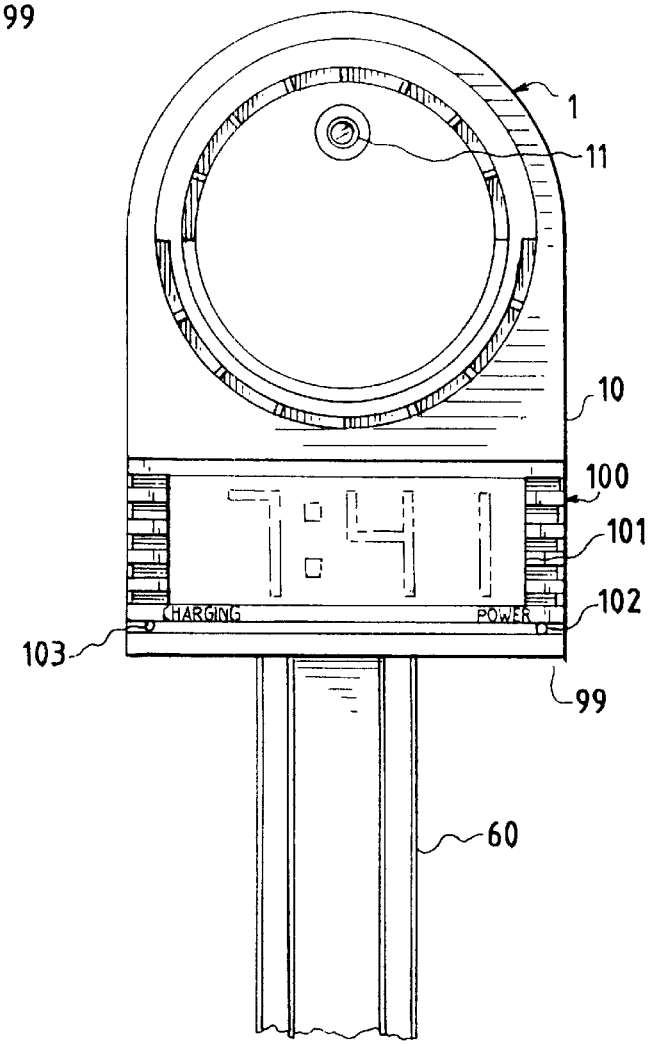
FIG. 4 is a front elevation view of the smoke detector apparatus of FIG. 1 with an attached back-up battery charger and clock accessory.

FIG. 4 depicts a digital clock and battery charger accessory 100. The digital clock and battery charger accessory 100 has a digital clock display 101 to display the current time. On the face of the digital clock and battery charger accessory 100 are a power indicator 102 and a charging indicator 103. The power indicator 102 is lit when the internal batteries are properly charged. The charging indicator 103 is lit whenever the internal batteries are in the process of recharging.

Figure 5:
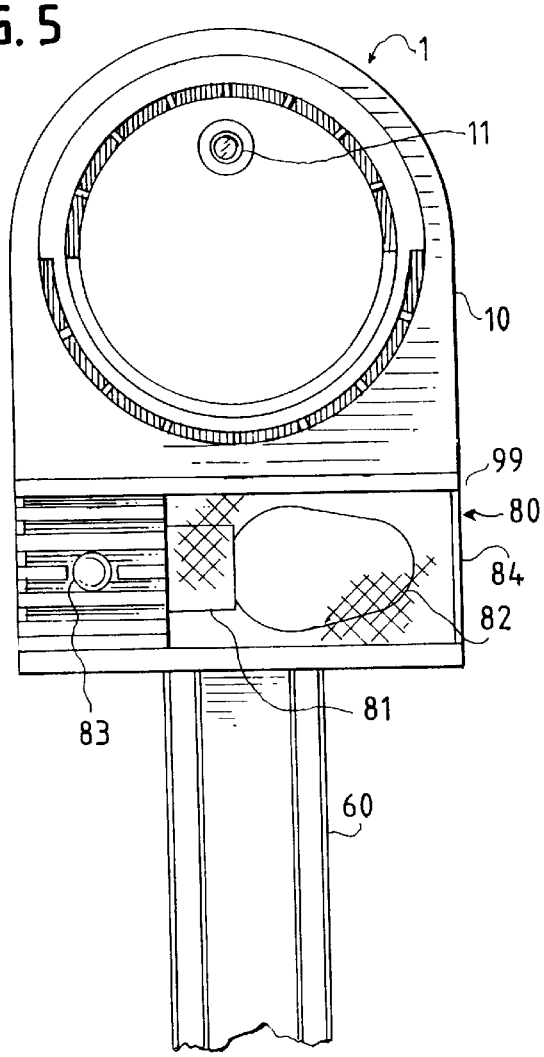
FIG. 5 is a front elevation view of the smoke detector apparatus of FIG. 1 with an attached nightlight accessory.

FIG. 5 depicts the smoke detector unit 10 with the attached nightlight accessory 80. The attached nightlight accessory 80 has an internal compartment which houses a lightbulb receptacle 81 and a corresponding lightbulb 82. On the face of the night light accessory is a light switch 83, which when activated allows power to flow to the lightbulb 82. When the light switch 83 is activated, the lightbulb 82 provides illumination through a transparent or translucent window 84.

Figure 6:
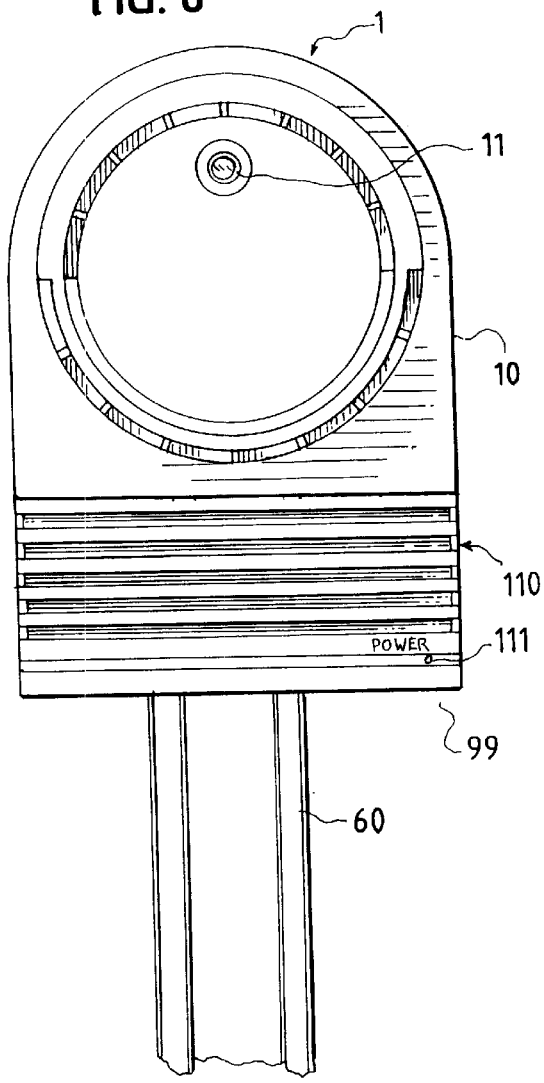
FIG. 6 is a front elevation view of the smoke detector apparatus of FIG. 1 with the addition of a carbon monoxide detector accessory.

FIG. 6 depicts the smoke detector unit 10 with an attached carbon monoxide detector accessory 110. The carbon monoxide detector accessory 110 alerts users of the presence of a dangerous level of carbon monoxide. Provided on the carbon monoxide detector accessory 110 is a power light 111. The power light 111 is lit when power is provided.

Figure 7:
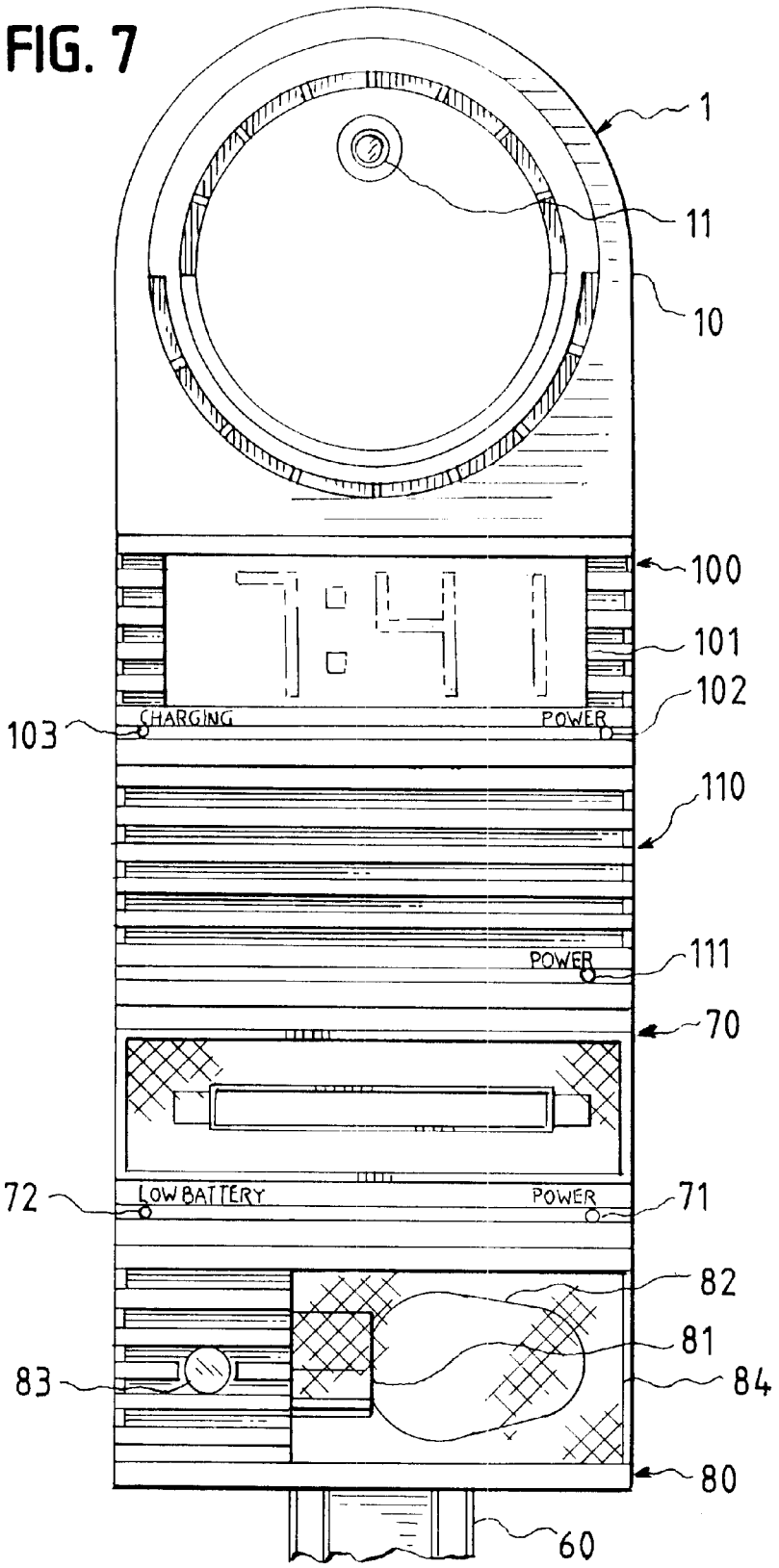
FIG. 7 is a front elevation view of the smoke detector apparatus of FIG. 1 with attached nightlight accessory, back-up battery charger and clock accessory, self-charging power-out light accessory, and carbon monoxide detector accessory.

The digital clock and battery charger accessory 100, power-out light accessory 70, nightlight accessory 80, and the carbon monoxide detector accessory 110 are interchangeably connectable, as illustrated in FIG. 7, to the smoke detector unit 10. The modularity of the accessories 99 permits the user of the smoke detector unit 10 to obtain the desired combination of complementary features.

Figure 2:
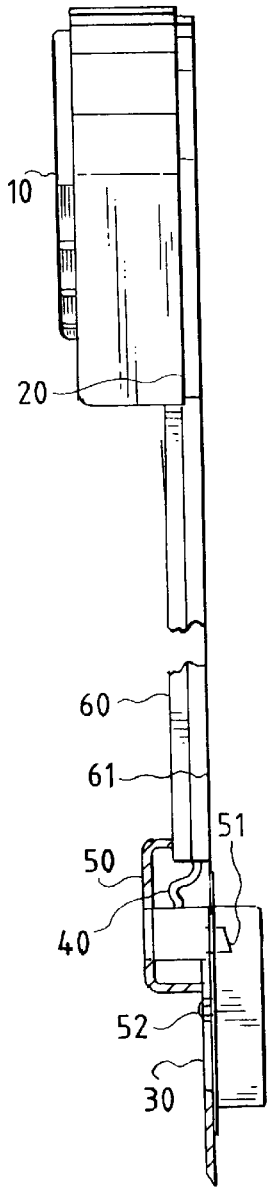
FIG. 2 is a side elevation view of the smoke detector apparatus of FIG. 1.
Figure 15:
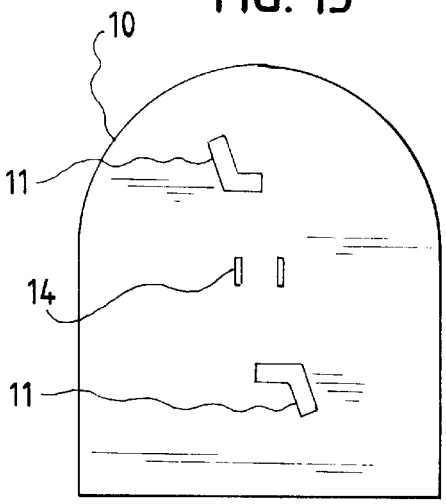
FIG. 15 is a back elevation view of the smoke detector unit of FIG. 2.
Figure 14:
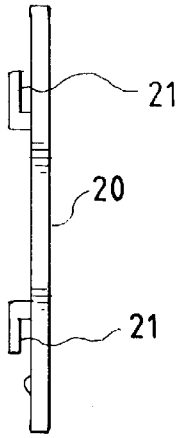
FIG. 14 is a side elevation view of the attachment plate of FIG. 2.

In another form of the invention an attachment plate 20 is mounted in the desired location for the smoke detector unit 10, as illustrated in FIGS. 1 and 2. The attachment plate 20 supports the smoke detector unit 10 and is preferably designed with mounting tabs 21 which interlock with mounting slots 11 on the back of the smoke detector unit 10, as illustrated in FIGS. 14 and 15. The attachment plate 20 preferably also has two compact slots 24 which allow power terminal tabs 14 of the smoke detector unit 10 to be inserted therein to make electrical contact as the smoke detector unit 10 is mounted onto the mounting tabs 21 for support, as illustrated in FIGS. 15–17.

Figure 16:
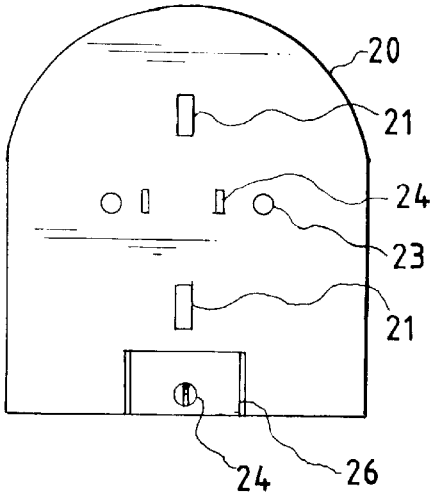
FIG. 16 is a back elevation view of the attachment plate of FIG. 2 with the door in its closed position.
Figure 17:
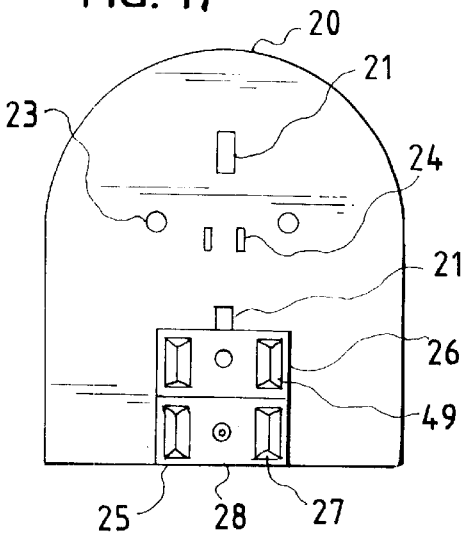
FIG. 17 is a back elevation view of the attachment plate of FIG. 2 with the door in its open position.

The attachment plate 20 also is preferably designed with a quick-connect feature 28, illustrated in FIGS. 16 and 17, to simplify the electrical connection with the power supply line 40. The quick connect 28 feature includes a compartment 25 with channels 49 for receiving both the wires 41 of the power supply line 40 and splicing terminals 27 for cutting through insulation 42 and making electrical contact with the wires 41 of the power supply line 40. A door 26 hinged to the attachment plate 20 can be closed to trap and press, by way of a tightening screw 24, the wires 41 into the channels 49 and splicing terminals 27, thereby making electrical contact. Once the power supply line 40 is in the quick-connect feature 28 and the smoke detector unit 10 is mounted to the attachment plate 20, power is able to flow to the smoke detector unit 10. It should also be noted that in order to enable use of the smoke detector unit 10 in a construction pre-wiring situation, the attachment plate 20 may also have gripping contact holes 24 incorporated into the design. Such holes 24 would allow stripped standard home 120 volt solid copper wire ends to be accommodated for connection as well.

Figure 8:
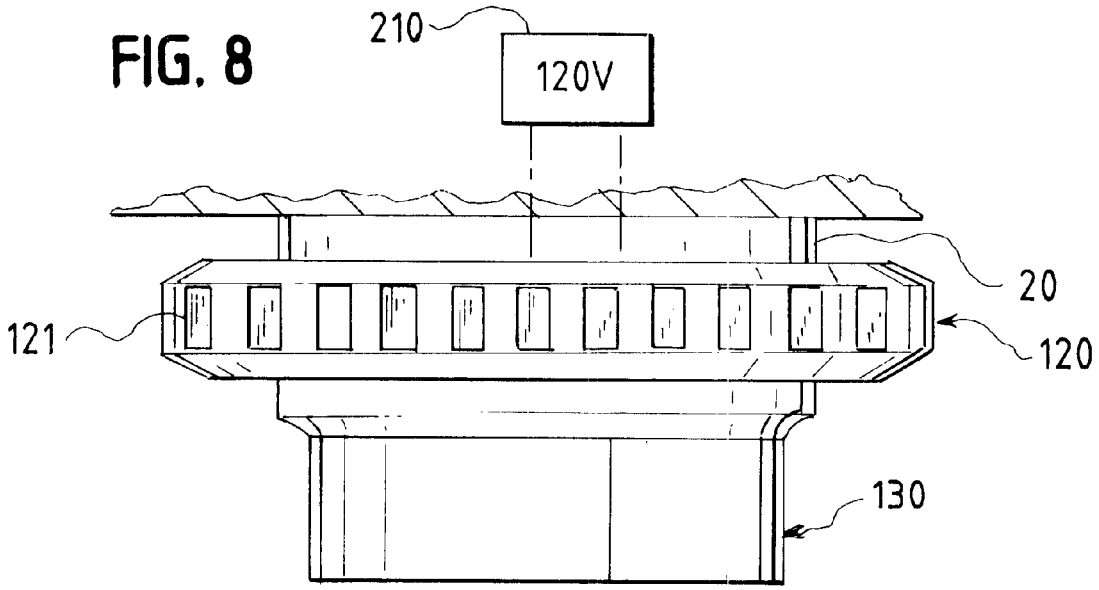
FIG. 8 is a side elevation view of a smoke detector that is attachable to a lighting pre-wire fixture on one side and provides for the mounting of a standard ceiling light fixture on the opposite side.
Figure 9:
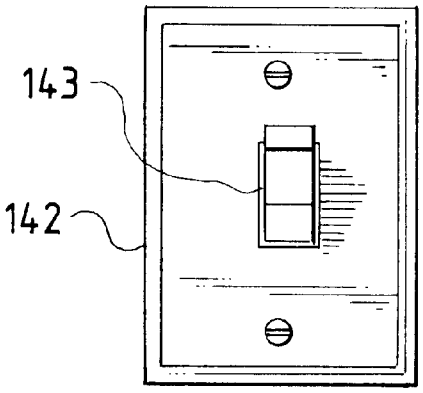
FIG. 9 is a front elevation view of a wall mounted switch unit with a radio transmitter.
Figure 10:
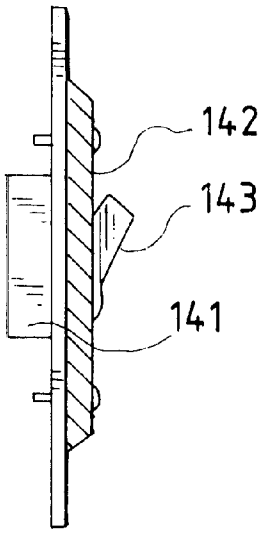
FIG. 10 is a side elevation view of the wall mounted switch of FIG. 9.

In another form of the invention a pre-wire smoke detector unit 120 is provided with the capability of attaching a light fixture 130, as illustrated in FIG. 8. In a situation where the light fixture 130 could mount directly to the ceiling, the attachment plate 20 of the smoke detector unit 120 is instead mounted. The exposed vents 121 of the smoke detector unit 120 incorporate a low profile so as to minimize the standoff between the ceiling and the light fixture 130. The smoke detector unit 120 may be connected to wires of the electrical system 210 with gripping contact holes 23. The power to the light fixture 130 may be controlled by a radio transmitter 141 mounted in a specifically designed replacement wall switch faceplate 142 , as illustrated in FIGS. 9 and 10. The wall switch faceplate 142 is designed to replace standard switch faceplates. A switch 143 activates the radio transmitter.

In another form of the invention, a smoke detector unit 150 is provided with an integrated standard female lightbulb socket 151 at one end and male socket threads 152 at the other end, as illustrated in FIG. 11. The male socket threads 152 are insertable into a female lightbulb socket 154, such as in a lamp 160, as illustrated in FIG. 19, or a ceiling fixture 161, as illustrated in FIG. 11. The smoke detector unit 150 is provided with a protective sheath 153 to cover the lightbulb switch 162 to ensure the lightbulb switch 162 remains in the on position, thereby providing continuous power to the smoke detector unit 150. The lightbulb switch 162 may be a pull chain, as illustrated in FIG. 11, or a push switch on the lamp 200, as illustrated in FIG. 19. The protective sheath 153 may have an exposed detector lightbulb switch 180 to turn on power to the female lightbulb socket 151 provided at one end of the smoke detector unit 150. Alternatively, the wall switch faceplate 142 described above, additionally provided with a recess for covering a standard wall switch 145 may be used, as illustrated in FIGS. 12 and 13. A standard lightbulb 170 is thus insertable therein and is operable in an illuminated and non-illuminated states while continuous power is provided to the smoke detector unit 150. The smoke detector unit 150 may have a hoop 205 attached thereto for supporting a lampshade 202 over the lightbulb in the smoke detector unit 10, as illustrated in FIG. 19.

While there have been illustrated and described particular forms of the present invention, it will be appreciated that numerous changes and modifications will occur to those skilled in the art, and it is intended in the appended claims to cover all those changes and modifications that fall within the true spirit and scope of the present invention.

What is claimed is:

1. An apparatus for providing uninterrupted power to a smoke detector unit via a wall outlet connected to an electrical system of a home or building, the apparatus comprising:

a small, portable housing of the smoke detector unit including electrical circuitry for receiving power to operate the smoke detector unit;

an elongated power supply line having spaced ends along its length for being connected to the electrical circuitry of the smoke detector unit at one end of the ends thereof;

an outlet cover plate integral with the power supply line at the other end thereof for being wall mounted over the outlet to maintain the power supply line thereto; and plug blades carried by the cover plate for being inserted into the wall outlet to supply power from the electrical system to the smoke detector circuitry via the power supply line.

2. The apparatus of claim 1 wherein the outlet cover plate includes fastener through openings and fasteners for insertion through the through openings and securing the plate to the wall against unintentional removal therefrom.

3. The apparatus of claim 1 wherein the power supply line includes outer insulation of a polymer material, and the outlet cover plate is integrally molded of the same polymer material as the power supply line insulation.

4. The apparatus of claim 3 wherein the outlet cover plate is molded as a decorative face plate.

5. The apparatus of claim 1 wherein the smoke detector unit includes a light for indicating when power is provided to the electrical circuitry of the smoke detector unit by the electrical system.

6. The apparatus of claim 1 wherein the smoke detector unit includes splicing terminals for cutting through insulation at the one end of the power supply line for electrically connecting the power supply line to the electrical circuitry of the smoke detector unit.

7. The apparatus of claim 1 including a conduit adjustably sized to match the length of the power supply line for attaching a portion of the power supply line along the length thereof to a wall of the house or building.

8. The apparatus of claim 1 wherein the outlet cover plate includes an opening for access to the wall outlet.

9. The apparatus of claim 8 wherein the cover plate includes a blocking member movable to block the opening to prevent access to the wall outlet.

10. The apparatus of claim 1 wherein the smoke detector unit includes a power outlet connected with the electrical circuitry therein for providing power to an accessory.

11. The apparatus of claim 10 wherein the accessory includes a battery for providing back-up power supply to the smoke detector and a battery charger for recharging the battery.

12. The apparatus of claim 10 wherein the accessory includes on of the following accessories: a clock for displaying time, a carbon monoxide detector for detecting carbon monoxide, or a light for providing illumination.

13. The apparatus of claim 10 wherein the accessory includes an accessory power outlet for receiving another accessory in electrical engagement.

14. An apparatus for providing uninterrupted power to a smoke detector unit via an electrical system in a home or building, the apparatus comprising:

a small, portable housing of the smoke detector unit including electrical circuitry for: receiving power to operate the smoke detector unit;

a switch that controls supply of power from the electrical system operable by a user between on and off states thereof;

an intermediate conductive member for supplying power from the electrical system to the electrical circuitry of the smoke detector unit; and a blocking member associated with the switch to substantially prevent user access thereto with the switch in the on state for maintaining uninterrupted power supply from the electrical system to the smoke detector unit and electrical circuitry therein, wherein the blocking member comprises a radio transmitter for sending radio signals including a fixture switch that controls the transmission of the radio signal for powering the female lightbulb socket of the smoke detector unit when the radio signal is received.

15. The apparatus of claim 14 wherein the intermediate conductive member includes a female lightbulb socket and the smoke detector unit has a male thread contact for insertion into the female lightbulb socket.

16. The apparatus of claim 14 wherein the blocking member includes a switch plate cover for mounting over a standard wall switch.

17. The apparatus of claim 14 wherein the housing of the smoke detector unit includes a female lightbulb socket for receiving electrical power from the electrical circuitry of the smoke detector unit.

18. The apparatus of claim 14 wherein the intermediate conductive member is a lamp with a bulb socket and a power supply line connected to the wall outlet, and the switch is disposed on the lamp for controlling the supply of power from the electrical system with the power supply line connected to the wall outlet.

19. The apparatus of claim 14 wherein the blocking member comprises a sheath of the housing that confines the switch to prevent user access thereto.

* * * * *